US007509767B2

(12) United States Patent
Bolen

(10) Patent No.: US 7,509,767 B2
(45) Date of Patent: Mar. 31, 2009

(54) BASE PAD FOR FIREARM MAGAZINE

(76) Inventor: John Bolen, 912 E. Center Ave., Visalia, CA (US) 93292

( * ) Notice: Subject to any disclaimer, the term of this patent is extended or adjusted under 35 U.S.C. 154(b) by 192 days.

(21) Appl. No.: 11/704,100

(22) Filed: Feb. 8, 2007

(65) Prior Publication Data

US 2008/0190003 A1 Aug. 14, 2008

(51) Int. Cl.
*F41A 9/61* (2006.01)
*F41C 27/00* (2006.01)

(52) U.S. Cl. ..... 42/50; 42/49.01; 42/49.02; 42/49.1; 89/33.1; 89/195; 89/197

(58) Field of Classification Search ..... 42/49.01, 42/49.02, 50, 49.1, 11, 17, 21, 24, 29, 33, 42/35, 37, 39, 7; 89/33.1, 195, 197
See application file for complete search history.

(56) References Cited

U.S. PATENT DOCUMENTS 2,715,789 A * 8/1955 Garand ..... 42/50
4,107,862 A * 8/1978 Sofinowski, III ..... 42/50
4,495,720 A * 1/1985 Bross ..... 42/7
4,520,585 A * 6/1985 Barrett ..... 42/7
4,592,160 A * 6/1986 Bross ..... 42/7
5,081,778 A * 1/1992 Switzer ..... 42/50
5,461,811 A * 10/1995 Ciener ..... 42/50
5,642,582 A 7/1997 Grams
5,651,204 A * 7/1997 Hulsey et al. ..... 42/50
5,666,752 A 9/1997 Grams
7,117,622 B2 * 10/2006 Freed et al. ..... 42/7

OTHER PUBLICATIONS

"Limcat Brass Base Pad" from www.shootersconnection.com, Jan. 27, 2007, 3 pages, Internet, US.
"Dawson Precision" from www.1911store.com, Jan. 27, 2007, 2 pages, Internet, US.

* cited by examiner

*Primary Examiner*—Bret Hayes
*Assistant Examiner*—Michael D David
(74) *Attorney, Agent, or Firm*—Richard A. Ryan

(57) ABSTRACT

An improved base pad for a firearm magazine that more securely attaches to the bottom of a magazine tube in a manner which is easier and faster to attach or remove therefrom when cleaning the magazine. The improved base pad has a body member with a pair of ends and a pair of sides. The sides each have a groove configured to slidably receive, preferably snugly, the lips at the bottom of a standard magazine tube. One end of the base pad has an outwardly extending section with an upwardly facing, generally planar face. A securing mechanism at the outwardly extending section has an upwardly disposed projection that selectively engages one wall of the magazine tube to secure the base pad thereto when in its engaged position and allows removal of the base pad when in a disengaged position. In a preferred embodiment, the securing mechanism is a detent device.

18 Claims, 5 Drawing Sheets

BASE PAD FOR FIREARM MAGAZINE

CROSS-REFERENCE TO RELATED APPLICATIONS

None.

BACKGROUND OF THE INVENTION

A. Field of the Invention

The field of the present invention relates generally to devices that improve the use and operation of firearms, including rifles and handguns. More particularly, the present invention relates to improvements to the base pad component of a firearm magazine. Even more particularly the present invention relates to such base pads that are configured to more quickly, easily and effectively attach to and disengage from the open bottom end of the magazine tube to secure multiple rounds in the magazine.

B. Background

Many people own and utilize firearms of the type that have a cavity in the firearm for receiving a magazine containing ammunition, commonly referred to as rounds or cartridges, which is fed to the firing mechanism for firing from the firearm. A common style of firearm is a handgun that is based on the Colt 1911 model, which has been the standard handgun for numerous military, police and related organizations. The Colt 1911 handgun utilizes a standard size magazine that, like all firearm magazines, comprises a generally elongated multiple round magazine tube having upstanding side walls that define a cartridge chamber which receives the rounds. The magazine tube has a shaped, open top from which the rounds are individually fed into the handgun's firing chamber, a spring mechanism having a follower that moves the rounds up the magazine tube to the firing chamber, an open bottom from which the spring/follower engages the rounds and a removable base pad that closes the open bottom and is biased against by the spring mechanism.

The multiple round magazine type of handgun is commonly utilized by the military, police and other groups where the ability to fire multiple rounds from a handgun and then quickly reload the handgun is of a paramount, even life threatening, importance. These types of handguns are also commonly utilized in sporting competitions where one user competes in various firing challenges against other handgun users and/or the clock. Typically, these competitions test the user's ability to quickly and accurately fire his or her handgun by generally simulating various real-life military and police situations. In the military/police or competition use of the handguns, it is commonly known that the handguns will be exposed to dirt, dust and other debris which is likely contaminate the magazine chamber and interfere with the operation of feeding rounds to the handgun's firing chamber. Because the magazine is ejected from the handgun after the user discharges all of the rounds therein, with the magazine often landing on the ground or another debris-laden surface, it is very difficult for the user to avoid exposure of the magazine to debris. Naturally, interference with the firing of the handgun can have a serious impact on the user's ability to rely on his or her handgun when the need arises.

Although pre-loaded multiple round magazines can be carried by the firearm user, many circumstances dictate that user also have the ability to quickly and easily reload a magazine. During the magazine reloading process, which is typically accomplished from the top of the magazine tube, it is generally advisable for the user to first clean the debris off of the magazine components by disengaging the base pad from the magazine tube and then removing the spring mechanism therefrom. In order to quickly accomplish the cleaning process, it is necessary that the base pad be configured to be quickly disengaged from the magazine tube and then be able to be quickly reattached thereto, with the spring mechanism, after the components are cleaned. In order to ensure effective and safe operation of the firearm, however, the base pad must also be configured so the user can, preferably in a rapid manner, securely reattach the base pad to the magazine tube when reassembling the magazine. As known to those skilled in the art, failure to properly secure the base pad to the magazine tube can result in catastrophic failure of the firearm.

The standard magazine tube has a lip at its lower end that extends outwardly from two side walls to engage a groove cut into the sides of the base pad, which is typically made of a plastic material, for a slide on operation. While this configuration generally works well for "normal" usage of the firearm, it is well known that the standard base pad has problems with regard to durability, unintended disengagement from the magazine tube and control of the spring mechanism when the user rapidly disengages the base pad from the magazine tube. Base pads made out of plastic or similar materials can be damaged by contact with the ground or other surface when the user ejects the magazine from the firearm. This is particularly true in rapid fire and reload situations where the user generally disregards, due to time constraints, the ejection path of the spent magazine. Because the standard base pad merely slides on the magazine tube, the user can unintentionally slide or partially slide the base pad off of it when his or her hand moves across or is placed on (i.e., to steady the handgun) the bottom of the handgun grip. The standard base pad has a relatively shallow cavity that receives the lower end of the spring mechanism. Unfortunately, when the base pad is removed from the magazine tube, particularly when done so in a hurry, the spring mechanism can fly out of the magazine tube, which results in lost time to gather the spring mechanism and more thoroughly clean it before reinserting it into the magazine tube.

Various improvements to the standard base pad are available. One such improvement is to manufacture the base pads out of a more durable, impact resistant material, such as aluminum, stainless steel or brass, in order to reduce the likelihood that the base pad will be damaged when the spent magazine is discharged from the firearm. Another improvement is to provide a deeper or extended base pad cavity that more effectively contains the spring mechanism when it is removed from the magazine tube, thereby reducing the likelihood that the spring mechanism has to be gathered. While these improvements can generally reduce the problems associated with the base pad being damaged by contact with the ground and the spring mechanism springing away, they have not sufficiently addressed the issue with regard to better securing the base pad to the magazine tube in a manner that also allows the user to quickly disengage the base pad therefrom when desired.

Various attempts have been made to provide a base pad that more effectively secures to the magazine tube in manner that allows it to be quickly disengaged therefrom for cleaning of the magazine components. One such improved base pad is disclosed in U.S. Pat. No. 5,642,582 to Grams, which describes a magazine base pad having a cavity in which the lower end of the magazine tube is inserted, as opposed to the base pad being slid onto the tube, a pair of channels on the sides of the cavity and a pin positioned in the channels. The bottom of the magazine tube is placed into the base pad cavity and then the pins, which are preferably the two legs of a single U-shaped pin or clip, are inserted into the channels to engage the upper side of the lip on the magazine tube and secure the base pad to the magazine tube. The user removes the base pad from the magazine tube by pulling the pin sufficiently out of the channels so the bottom of the magazine tube can be pulled out of the cavity. Although this base pad is easy to use and does function as intended, the pins or U-shaped clip can be pulled too far out of the channels and, if dropped, get lost or require extra time to retrieve and place back in the channels. Limcat Custom Products has a base pad that utilizes a swinging door-like mechanism with a groove in the door portion that engages the lip on the magazine tube when the lower end thereof is inserted into the base pad cavity and the door is closed. A detent mechanism is used to secure the door closed. The door can be damaged and the base pad can wear to the point where the magazine tube can pop off the base pad without disengaging the locking mechanism. Another base pad, manufactured by Dawson Precision, utilizes a sliding door mechanism having a door component that slides along one side of the base pad. A groove in the sliding door engages the lip on the bottom of the magazine tube, which is also inserted inside the base pad cavity like the above base pads, when the door is slid shut. The door can be damaged when open, the door mechanism can become loose through wear and the user can unintentionally slide open the door when reloading the magazine.

Although the standard base pad and the various replacement base pads are generally sufficient for closing the open bottom end of a magazine tube and for allowing the user to remove the base pad to clean the magazine, what is needed is an improved base pad that more quickly and securely attaches to the magazine tube and is easily and quickly disengaged therefrom without the risk of losing pins/clips or damaging doors. The preferred base pad will be configured for use with standard magazine tubes and configured to slidably engage the lip on the bottom of the magazine tube. Preferably, an improved base pad will include a securing mechanism that secures the base pad to the magazine tube without the use of pins/clips or doors. The preferred securing mechanism should prevent the base pad from unintentionally sliding off the magazine tube during use or reloading of the firearm, yet be easy for the user to disengage so that he or she may remove the base pad when desired to clean the magazine. The base pad should be adaptable to being manufactured out of a variety of materials, including metals such as aluminum and the like which are lightweight, durable and generally impact resistant.

SUMMARY OF THE INVENTION

The improved base pad for firearm magazine of the present invention solves the problems and provides the benefits identified above. That is to say, the present invention discloses a base pad for a firearm magazine that is configured to be easily and quickly secured to the bottom of the magazine tube to secure multiple rounds in the tube and then be easily and quickly disengaged therefrom to allow the user to clean the magazine. In a preferred embodiment of the present invention, the improved base pad is configured to slide onto the lip at the bottom of a standard magazine tube in much the same manner as a standard base pad. The improved base bad includes a securing mechanism that engages one of the upstanding sidewalls which define the magazine tube after the base pad is slid onto the magazine tube to securely hold the base pad thereon. In a preferred embodiment, the securing mechanism automatically locks into place against one of the magazine tube sidewalls after the base pad is slid onto the magazine tube and is easy and fast to disengage therefrom to allow the user to remove the base pad for cleaning the magazine. The base pad of the preferred embodiment eliminates the use of pins, clips, doors or like devices that can be lost or damaged during use or cleaning and result in the base pad being unable to be attached to the magazine tube.

In one general aspect of the present invention, the improved base pad for a firearm magazine comprises a body member having a first end and an opposing second end, a first side and an opposing second side, and a bottom that, collectively, define a base pad cavity. Preferably, the body member is made out of a durable, generally shatter resistant material such as aluminum, stainless steel or other metals and the base pad cavity is deeper than a standard base pad to allow additional rounds to be stored in the magazine. Each of the first side and second side have a groove, configured much like the grooves in the conventional or standard base pad, that slidably receive the outwardly projecting lips at the bottom of the magazine tube that defines the cartridge chamber in which the rounds are stored. A securing mechanism at the first end of the body member is configured to engage one of the endwalls of the magazine tube when it is the lips are disposed in the grooves so as to prevent the magazine tube and base pad from inadvertently separating. In the preferred embodiment, the securing mechanism has an upwardly projecting member that engages the endwall of the magazine tube and the securing mechanism is disposed in or at an outwardly extending section located at the first end of the body member. Also in the preferred embodiment, the outwardly extending section has an upwardly facing, generally planar surface with an aperture disposed therein in which the upwardly projecting member is disposed. In this embodiment, the securing mechanism is configured to extend upward and engage the endwall when it is in its engaged position, thereby preventing separation of the base pad and magazine tube, and to be generally received into the aperture to allow removal of the base pad when it is in its disengaged position. In the preferred embodiment, the securing mechanism is a detent device and the upwardly disposed projection is a spring-driven ball. In an alternative embodiment, the securing mechanism comprises a screw, such as a set screw, that is threadably received in an aperture disposed in the outwardly extending section. In use, the lips of the magazine tube slide into the grooves on the base pad while the securing mechanism is in its disengaged or lowered position until one end of the magazine tube abuts the second end of the body member, at which time the upwardly disposed projection engages or abuts the opposite end of the magazine tube to effectively trap the bottom of the magazine tube into the base pad so as to secure the base pad to the magazine tube. As such, the base pad is securely attached to the magazine tube without the use of pins, clips or doors. The base pad is separated from the magazine tube by pressing downward on the upwardly disposed projection and sliding the lips of the magazine tube from the grooves in the base pad.

Accordingly, the primary objective of the present invention is to provide an improved base pad for a firearm magazine that provides the advantages discussed above and overcomes the disadvantages and limitations associated with presently available replacement firearm magazine base pads.

It is also an important object of the present invention to provide an improved base pad for a firearm magazine that easily, quickly and securely attaches to the bottom of a magazine tube and which can be easily and quickly disengaged therefrom for cleaning the magazine.

It is also an important object of the present invention to provide an improved base pad for a firearm magazine that removably attaches to the open bottom of a standard magazine by slidably engaging the lip on the magazine tube and utilizing a securing mechanism that abuttingly engages one of the sidewalls of the magazine tube.

It is also an important object of the present invention to provide an improved base pad for a firearm magazine that does not required the use of pins, clips, doors or like devices to securely attach the base pad to the lip at the bottom of a magazine tube.

It is also an important object of the present invention to provide an improved base pad for a firearm magazine that slides onto the lip at the bottom of a standard magazine tube and is secured thereto in a manner that prevents the base pad from unintentionally disengaging therefrom during use or reloading.

It is also an important object of the present invention to provide an improved base pad that can be manufactured out of a wide variety of different materials, including aluminum and the like, which are lightweight, durable and generally impact resistant.

It is also an object of the present invention to provide an improved base pad for a firearm magazine that, while preferably configured to attach to a magazine tube used with the Colt 1911 model handgun, is also adaptable to a wide variety of different sizes and configurations of magazines that are used for a variety of different firearms, including rifles and handguns.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of a preferred embodiment and represents one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein are described as being for use with a magazine that is configured to be utilized with a Colt 1911 type of handgun, those skilled in the art will readily understand that this is merely for purposes of simplifying the present disclosure and that the present invention is not so limited, as the present invention is equally applicable for use with magazines configured for other types of firearms, including rifles and handguns.

Figure 2:
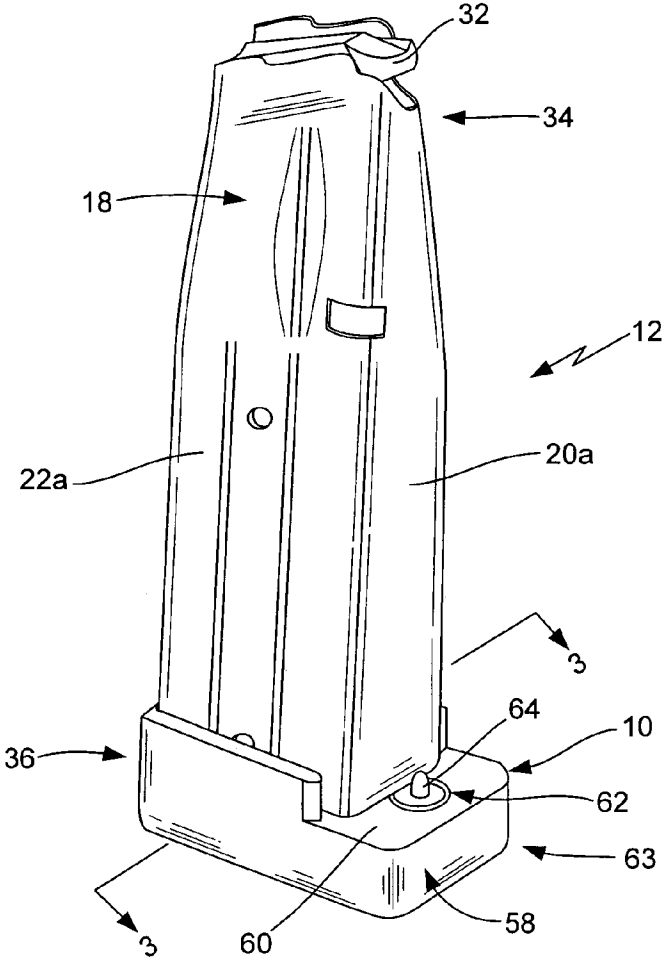
FIG. 2 is a front side perspective view of the base pad for a firearm magazine configured according to a preferred embodiment of the present invention shown attached to the magazine tube of FIG. 1 with the securing mechanism in its engaged position.
Figure 3:
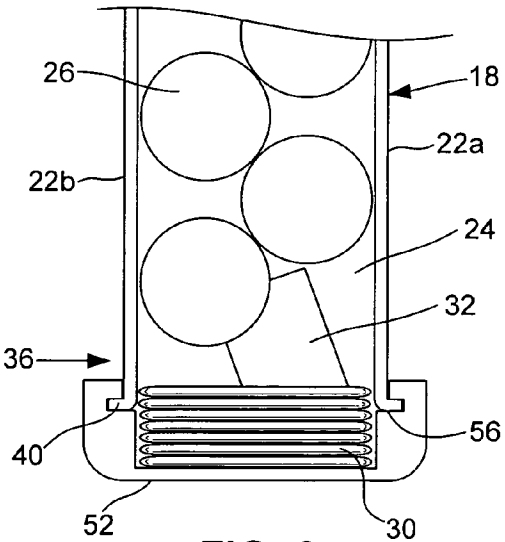
FIG. 3 is a cross-sectional view of the lower portion of the magazine of FIG. 2 with a plurality of rounds in the cartridge chamber, taken along sectional line 3-3, showing the spring mechanism biasing the rounds upward in the magazine tube.
Figure 6:
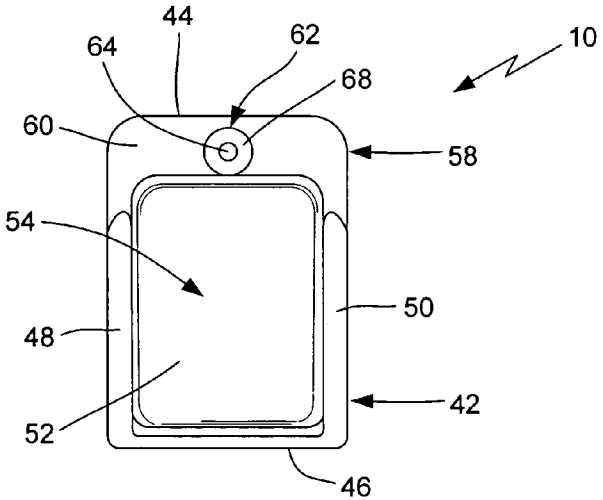
FIG. 6 is a top plan view of the base pad of FIG. 5.
Figure 7:
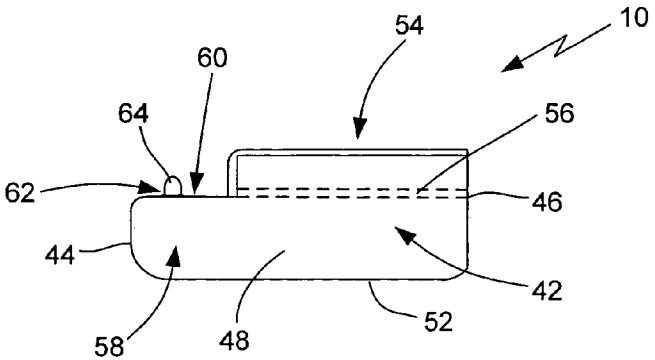
FIG. 7 is a side elevation view of the base pad of FIG. 5.

A base pad that is manufactured out of the components and configured pursuant to a preferred embodiment of the present invention is shown generally as 10 in FIGS. 2 through 10. Base pad 10 is configured to be part of an improved firearm magazine 12, best shown in FIGS. 2 and 4, that is understood to be received in a cavity disposed in the grip portion of a handgun (not shown), such as the Colt 1911 type of handgun which is utilized by various military/police organizations and by many people who participate in competition shooting. Other than base pad 10, magazine 12 is the same as a prior art magazine, an example of which is shown as 14 in FIG. 1 with a prior art base pad 16, that is typical of existing firearm magazines. Magazines 12 and 14 comprise a magazine tube 18 having a plurality of upstanding walls, such as endwalls 20*a* and 20*b* and sidewalls 22*c* and 22*b* that define a cartridge chamber 24, shown in FIG. 3, configured to hold a plurality of rounds 26 to be fired by the firearm. The rounds 26 held in cartridge chamber 24 are pushed upward to the firearm's firing chamber through magazine tube 18 by a spring mechanism 28, shown in FIGS. 3 and 4, comprising a spring 30 and follower 32. Typically, follower 32 is shaped and configured to cooperatively guide an individual round 26 through the open top 34 of magazine tube 18. In the prior art magazine 14 of FIG. 1, spring 30 biases against base pad 16, which is configured to close the otherwise open bottom 36 of magazine tube 18. As best shown in FIG. 3, in the improved magazine 12, spring 30 biases against base pad 10 to guide the rounds 26 upward through cartridge chamber 24 of magazine tube 18 and also close the otherwise open bottom 36, best shown in FIG. 4, of magazine tube 18.

Figure 1:
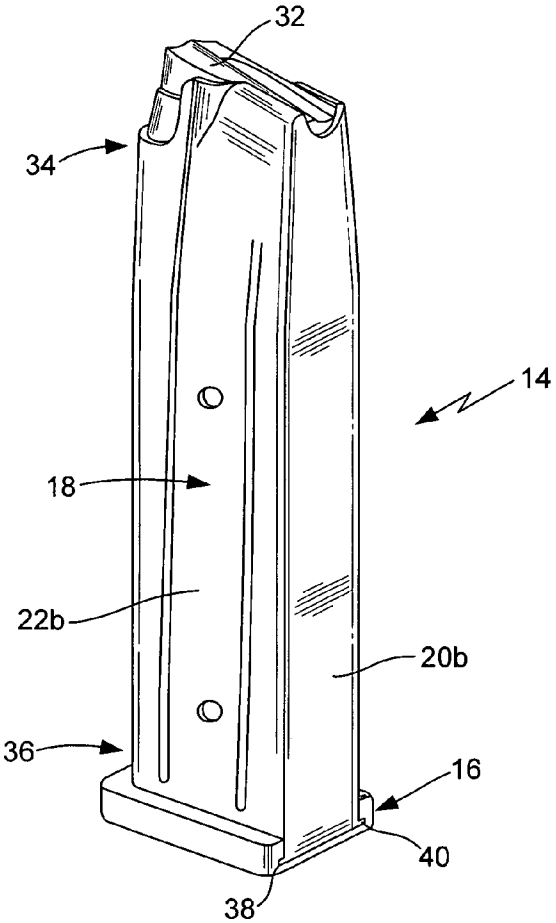
FIG. 1 (PRIOR ART)
FIG. 1 is a rear side perspective view of a prior art magazine, which is configured for use with a Colt 1911 type of handgun, having a prior art base pad shown attached thereto.

As well understood by those skilled in the art, the prior art base pad 16 has a pair of grooves 38 which are configured to engage a pair of lips 40 at the bottom 36 of magazine tube 18, as shown in FIG. 1, by sliding the lips 40 of magazine tube 18 into base pad 16. As best shown in the exploded view of FIG. 4, the pair of lips 40 extend outwardly from the sidewalls 22 and are configured to somewhat snugly or tightly engage grooves 38. As discussed and shown in detail in U.S. Pat. No. 5,642,582, prior art base pad 16 includes a platform inside the base pad cavity, which is shallow, that has a downwardly extending boss which extends through an aperture in the bottom of base pad 16. When the grooves 38 of base pad 16 are slid over the lips 40 of magazine tube 18 the platform is biased against the inside bottom of base pad 16 by spring 30 to push the boss through the aperture. As those who are familiar with the operation of the prior art base pad 16 know, the user pushes upward on the boss through the aperture to push the platform against the spring 30 in order to counter its biasing force and enable the user to slide base pad 16 off of magazine tube 18. Because of the shallow depth of the cavity in base pad 16, this must be done carefully to avoid spring 30 and/or the platform from flying out of the magazine tube 18. Naturally, whether in a police, military or competition setting, such an occurrence can significantly delay the user's ability to reassemble the magazine 14 after cleaning.

As explained in more detail below, the improved base pad 10 of the present invention also has grooves that slidably engage lips 40 so that base pad 10 slides onto the bottom 36 of magazine tube 18 in a manner similar to that for prior art base pad 16, except the platform, boss and aperture referenced above are not necessary for base pad 10. As best shown in FIGS. 5 through 10, base pad 10 comprises a body member 42 having a first end 44, an opposing second end 46, a first side 48, an opposing second side 50 and a bottom 52 that define a base pad cavity 54. As will be recognized by those skilled in the art, body member 42 can be manufactured out of a variety of different materials, including plastic and the like to accomplish the objectives of the present invention. In the preferred embodiment, however, body member 42 of base pad 10 is made out of a more durable and damage resistant material, such as aluminum or the like. Although base pad 10 can have a shallow base pad cavity 54 similar to that of the prior art base pad 16 shown in FIG. 1, it is preferred that base pad 10 have the deeper base pad cavity 54 shown in FIGS. 2 through 10. In addition to providing space for more rounds 26 in cartridge chamber 24, for the same spring 30, the deeper base pad cavity 54 provides a more secure receptacle for the lower end of spring 30 that will reduce the likelihood of spring 30 flying off from magazine 12 during disassembly for cleaning or its reassembly after the cleaning operations are complete. Second end 46 and sides 48/50 are sized and configured to generally follow the contour of the bottom 36 of magazine tube 18. As best shown in FIG. 5, first end 44 is generally open between sides 48/50 to allow the sidewalls 22*a*/22*b* at the bottom 36 of magazine 18 to slide between the sides 48/50 of base pad 10. When base pad 10 is securely attached to magazine tube 18, as shown in FIG. 2, endwall 22*b* will generally abut second end 46. The open section between sides 48/50 towards first end 44 should be sufficiently wide to receive magazine tube 18 therebetween.

Grooves 56 in each of the sides 50/52 are sized and configured to slidably receive lips 40 at the bottom 36 of magazine tube 18 so that sidewalls 22*a*/22*b* will slide against sides 48/50. In the preferred embodiment of base pad 10, as with the standard prior art base pad 16, grooves 56 are configured to snugly receive lips 40. Unlike several of the prior art base pads described above, including the base pad of U.S. Pat. No. 5,642,582, the ends 44/46 and sides 48/50 of base pad 10 of the present invention do not form a container in which the bottom 36 of magazine tube 18 is vertically inserted into base pad cavity 54, which requires a pin, clip or door type of arrangement to engage the lips 40 on the bottom 36 of magazine tube 18 in order to securely attach the base pad to the magazine tube 18. As set forth below, in addition to the operation being somewhat similar to the standard prior art base pad 16, this arrangement also provides benefit to the user if the securing mechanism that secures base pad 10 to magazine tube 18 were to fail, which is generally not available in the other prior art base pads.

The improved base pad 10 of the present invention has an outwardly extending section 58 at first end 44 with a generally planar upwardly facing surface 60 thereon that is configured to allow the bottom 36 of magazine tube 18 to slide across as it is received between sides 48/50 and lips 40 slidably engage grooves 56 on sides 48/50. To secure base pad 10 on magazine tube 18, the preferred embodiment of base pad 10 has a securing mechanism, shown generally as 62, at outwardly extending section 58 that is configured to selectively engage endwall 20*a* of magazine tube 18, which is disposed in the direction of first end 44 of body member 42. As best shown in FIG. 2, when base pad 10 is slid onto the bottom 36 of magazine tube 18 securing mechanism 62 generally engages, by abutting or near abutting relationship, the endwall 20*a* of magazine tube 18. With securing mechanism 62 in its engaged position 63, as best shown in FIG. 2, it will prevent magazine tube 18 from sliding out from between sides 48/50 with lips 40 in grooves 56, thereby preventing base pad 10 from being unintentionally separated from magazine tube 18. As will be readily understood by those skilled in the art, it is generally not necessary that securing mechanism 62 tightly abut endwall 20*a* (just as it is also not necessary that second end 46 and sides 48/50 tightly abut endwall 20*b* and sidewalls 22*a*/22*b*, respectfully) to achieve the objectives of the present invention. While it is generally beneficial to limit the amount of space between the ends and sides and between securing mechanism 62 and endwall 20*a*, so as to limit the amount of wiggle and clanking between magazine tube 18 and base pad 10, it will only be required that the securing mechanism 62 be close enough to prevent magazine tube 18 from moving generally outward. A tight engagement between base pad 10 and magazine tube 18 does have the additional benefit of reducing the likelihood, relative to a loose fit, that dirt or other contaminants will come into the cartridge chamber 24 at the interface between the base pad 10 to magazine tube 18.

Figure 4:
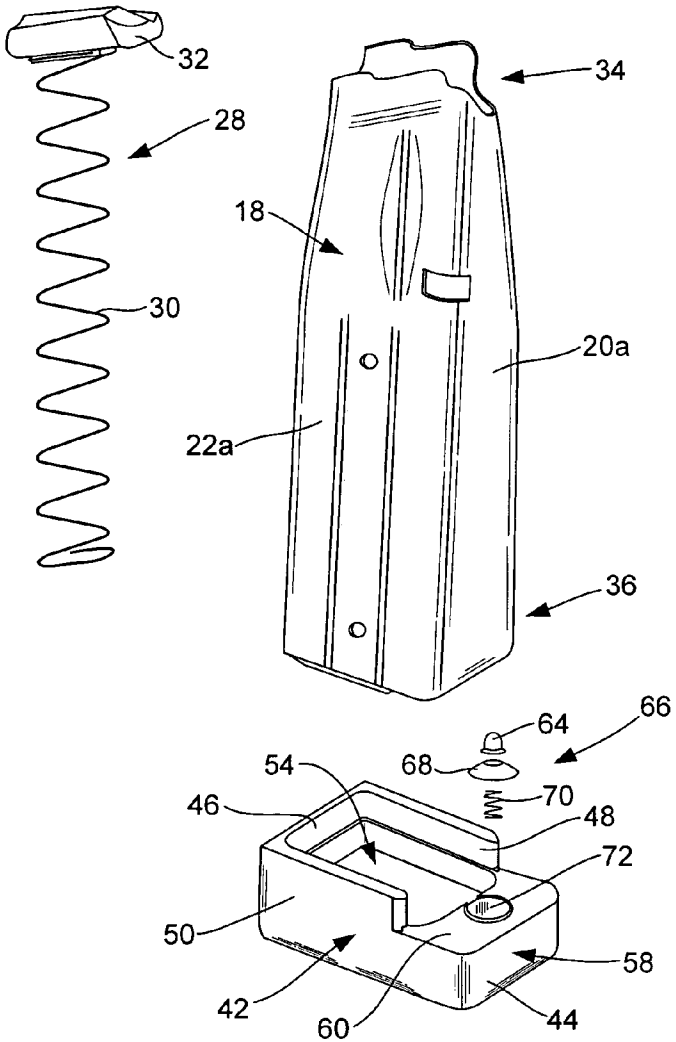
FIG. 4 is an exploded perspective view of the magazine of FIG. 2.
Figure 5:
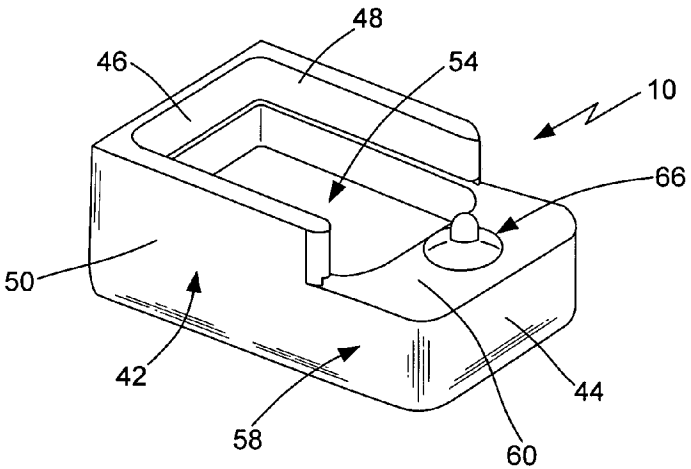
FIG. 5 is a top perspective view of the base pad of FIG. 2.
Figure 10:
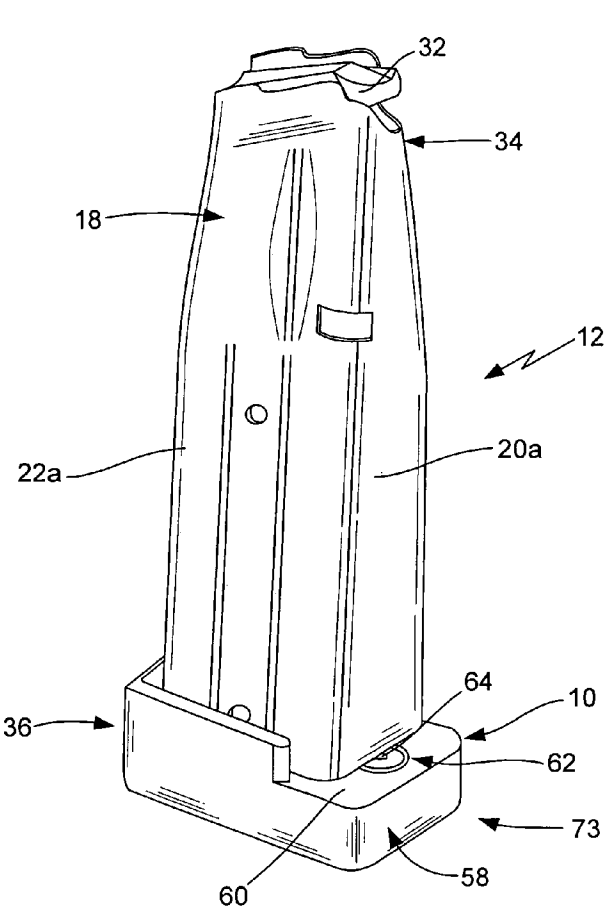
FIG. 10 is a front side perspective view of the base pad for a firearm magazine configured according to a preferred embodiment of the present invention shown attached to the magazine tube of FIG. 1 with the securing mechanism in the disengaged position.
Figure 8:
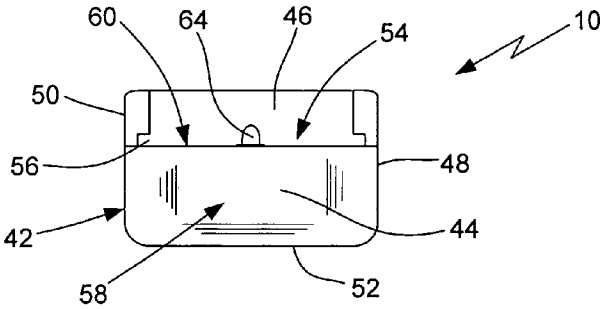
FIG. 8 is an end elevation view of the base pad of FIG. 5.
Figure 9:
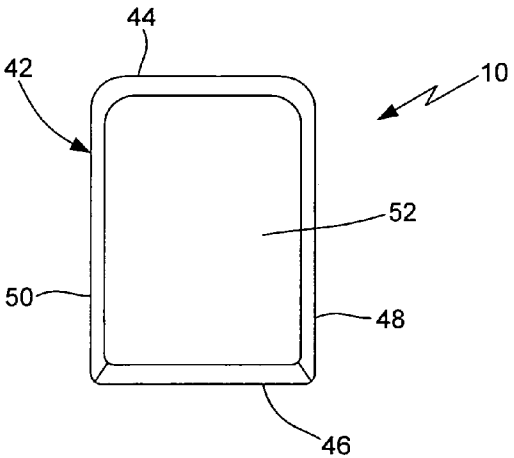
FIG. 9 is a bottom plan view of the base pad of FIG. 5.

In the preferred embodiment of the present invention, securing mechanism 62 comprises an upwardly disposed projection, in the form of a ball 64 that is part of a spring-loaded ball detent device 66, which is best shown in FIG. 4. As best shown in FIGS. 2, 5, 7 and 8, ball 64 projects upwardly from outwardly extending section 58 such that it projects above planar surface 60 to substantially block movement of magazine tube 18 towards first end 44 of base pad 10 and prevent base pad 10 from being unintentionally disengaged from magazine tube 18. In its engaged position 63, as shown in FIG. 2, the upwardly disposed projection (ball) 64 is placed in generally abutting relationship with endwall 20*a* of magazine tube 18. Any substantial forward movement of magazine tube 18 toward first end 44 of base pad 10 will be blocked by ball 64 projecting above the planar surface 60 of outwardly extending section 58. As stated above, in the preferred embodiment ball 64 is part of a spring-loaded ball detent device 66 that also comprises a retaining plate 68 and spring 70 that are operatively received in an aperture 72 disposed in planar surface 60 of outwardly extending section 58, as shown in FIG. 4. As will be understood by those skilled in the art, detent device 66 is configured such that downward pressure on ball 64 will compress the spring to sufficiently lower ball 64 (i.e., into aperture 72 below planar surface 60) and place securing mechanism 62 in its disengaged position 73 (shown in FIG. 10) so magazine tube 18 can be slid into area formed by second end 46 and sides 48/50. With ball 64 pushed down, magazine tube 18 can be moved into position with lips 40 thereof engaging grooves 56 in sides 48/50 of body member 42. Once endwall 20*a* passes securing mechanism 62, the downward pressure on ball 64 is released to allow spring 70 to bias ball 64 upward so ball 64 returns to its naturally biased state, which is also the engaged position 62, to generally abut endwall 20*a* and prevent magazine tube 18 from disengaging from base pad 10. Removal of base pad 10 from magazine tube 18, which is accomplished by placing securing mechanism 62 in its disengaged position 73 shown in FIG. 10 and sliding the bottom 36 of magazine tube 18 outward so that lips 40 slide out of grooves 56, requires downward pressure on ball 64. Because of the force required to bias spring 70 and the relatively small size of ball 64, in the preferred embodiment, this is not likely to occur unintentionally. As such, the user will be able to utilize and reload his or her firearm without concern that base pad 10 will separate from magazine tube 18. In addition, because there are no pins, clips or doors to get lost or break, base pad 10 will be much more reliable. Even if securing mechanism 62 were to fail, which should be configured to be very unlikely, base pad 10 will not easily fall off of the bottom 36 of magazine tube 18. In fact, any such failure of securing mechanism 62 will place magazine 12 in much the same condition as the standard prior art base pad 18 (i.e., effectively like magazine 14), with the lips 40 disposed in grooves 56.

In use, spring mechanism 28 is placed into the cartridge chamber 24 of magazine tube 18 with the follower 32 disposed at the top 34 thereof, in the same manner as with prior art base pads. In the preferred embodiment with ball detent device 66 as the securing mechanism 62, the lower end of the spring 30 is placed against the upwardly facing planar surface 60 of outwardly extending section 58 with a portion of spring 30 hooked against ball 64. Magazine tube 18 is then pushed downward towards planar surface 66 to compress the spring 30 in cartridge chamber 24. The bottom 36 of magazine body 18 is then moved towards second end 46 and lips 40 are directed into grooves 56 on first 48 and second 50 sides until ball 64 abuts the inside of endwall 20*a*. Magazine tube 18 is then tilted upward at endwall 20*a* so that endwall 20*a* is placed generally above or on top of ball 64. With a slight downward force at endwall 20*a* to push ball 64 down and place securing mechanism 62 in its disengaged position 73, the bottom 36 of magazine tube 18 is then slid the remaining distance toward second end 46. Once endwall 20*a* passes ball 64, ball 64 will be biased upward by spring 70 to place securing mechanism 62 in its engaged position 63 and securely attach base pad 10 to magazine body 18 and form the improved magazine 12 shown in FIG. 2. When the user desires to clean magazine 12, he or she pushes ball 64 down to place securing mechanism 62 in its disengaged position 73, shown in FIG. 10, and then slides the lips 40 at the bottom of magazine tube 18 outward from grooves 56. Once lips 40 are out of grooves 56, the user can pull upward on magazine tube 18 to separate base pad 10 therefrom.

Figure 11:
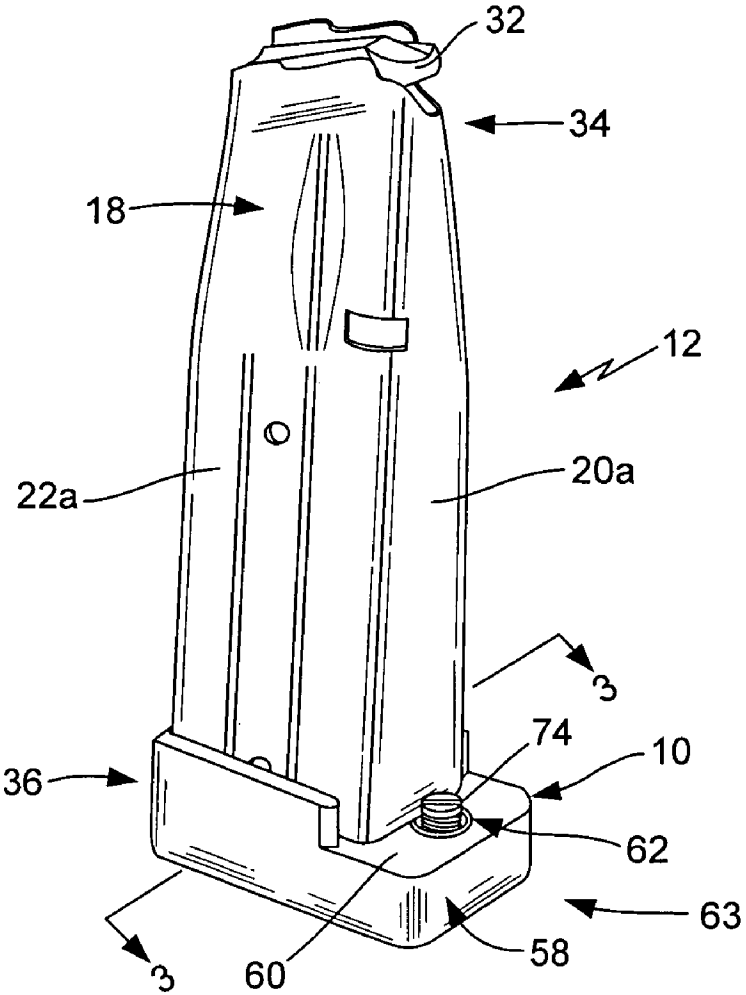
FIG. 11 is a front side perspective view of an alternative embodiment of the base pad for a firearm magazine of the present invention shown attached to the magazine tube of FIG. 1.

Securing mechanism 62 for base pad 10 of the present invention can be configured in a variety of different ways and with different mechanisms to cause an upwardly disposed projection, such as ball 64, to move from the disengaged position 73 to the engaged position 63. Although the use of a device, such as ball detent device 66, that automatically moves the upwardly disposed projection into place to generally abut endwall 20*a* is preferred, other types of devices may also be utilized with base pad 10. For instance, as shown in FIG. 11, base pad 10 can comprise a device that must be manually moved between the engaged 63 and disengaged 73 positions. In the alternative embodiment of FIG. 11, securing mechanism 62 comprises a connecting element, such as set screw 74, that is threadably received in aperture 72, which is cooperatively threaded. To utilize base pad 10 of this embodiment, the user turns (typically with a screwdriver, allen wrench or other appropriately configured tool) set screw 74 in the upward direction to place securing mechanism 62 in its engaged position 63, as shown in FIG. 11, and in the downward direction to place securing mechanism 62 in the disengaged position 73 (not shown for set screw 74). In the embodiment of FIG. 11, the user engages and operates set screw 74 from above planar surface 60. Those skilled in the art will readily understand that aperture 72 can pass completely through outwardly extending section 58 so that set screw can be operated from the bottom side of outwardly extending section 58 or be selectively operated from either above or below. In addition, a variety of screws, bolts or other connecting elements can be utilized for securing mechanism 62 to engage endwall 20*a* of magazine tube 18. In a preferred configuration, any connecting elements, such as set screw 74, utilized for securing mechanism 62 are configured such that cannot be completely removed from aperture 72 or base pad 10 so they will not get dropped or lost during the cleaning process.

In another embodiment, not shown, base pad 10 can be configured such that the securing mechanism 62 is at the first end 44 of body member 42 without the use of outwardly extending section 58 or with only a partial section 58. For instance, securing mechanism 62 can be attached to the first end 44 of body member 42 or at first side 48, second side 50 or bottom 52 near the first end 44 in a manner such that it extends upwardly or sideways to engage endwall 20*a* and prevent the lips 40 on magazine body 18 from disengaging from grooves 56 of base pad 10, as described above. In one such embodiment, a ring or other such member extends from the first end 44 to provide the aperture in which ball 64 or set screw 74 is received to selectively move between the engaged position 63 and disengaged position 73. A variety of other devices may also provide the desired engagement of the upwardly disposed projection (i.e., ball 64 or screw 74) with endwall 20*a*.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. An improved base pad for attachment to an open bottom of a magazine tube having a pair of sidewalls, a pair of endwalls and a lip on each of the sidewalls at the bottom of the magazine tube, said base pad comprising:

a body member having a first end, an opposing second end, a first side, an opposing second side and a bottom, said second end, said first side and said second side generally shaped to correspond to the contour of the bottom of the magazine tube;

a groove in each of said first side and said second side, said groove sized and configured to slidably receive the lip on the sidewalls of the magazine tube and attach said base pad to the bottom of the magazine tube; and a securing means at said first end of said body member for engaging one of the endwalls of the magazine tube to secure said base pad to the bottom of the magazine tube when in an engaged position and allowing separation of said base pad from the magazine tube when in a disengaged position.

2. The base pad according to claim 1, wherein said securing means comprises an upwardly disposed projection at or near said first end of said body member which selectively extends upward to engage the endwall of the magazine tube when said securing means is in said engaged position.

3. The base pad according to claim 2, wherein said securing means comprises a detent device.

4. The base pad according to claim 3, wherein said upwardly disposed projection is a ball.

5. The base pad according to claim 2, wherein said securing means comprises a screw.

6. The base pad according to claim 1, wherein said body member further comprises an outwardly extending section having a planar surface at said first end thereof, said securing means disposed in said outwardly extending section.

7. The base pad according to claim 6 further comprising an aperture in said outwardly extending section.

8. The base pad according to claim 7, wherein said securing means comprises an upwardly disposed projection which selectively extends upward from said aperture above said planar face to engage the endwall of the magazine tube when said securing means is in said engaged position.

9. The base pad according to claim 8, wherein said securing means is a ball detent device and said upwardly disposed projection is a ball.

10. The base pad according to claim 8, wherein said securing means is a screw threadably received in said aperture.

11. An improved base pad for attachment to an open bottom of a magazine tube having a pair of sidewalls, a pair of endwalls and a lip on each of the sidewalls at the bottom of the magazine tube, said base pad comprising:

a body member having a first end, an opposing second end, a first side, an opposing second side and a bottom defining a base pad cavity, said second end, said first side and said second side generally shaped to correspond to the contour of the bottom of the magazine tube, said body member having an outwardly extending section with a upwardly facing generally planar surface at said first end;

a groove in each of said first side and said second side, said groove sized and configured to slidably receive the lip on the sidewalls of the magazine tube and attach said base pad to the bottom of the magazine tube; and a securing means at said outwardly extending section for engaging one of the endwalls of the magazine tube to secure said base pad to the bottom of the magazine tube when in an engaged position and allowing separation of said base pad from the magazine tube when in a disengaged position.

12. The base pad according to claim 11, wherein said securing means comprises an upwardly disposed projection which selectively extends upward from said planar surface to engage the endwall of the magazine tube when said securing means is in said engaged position.

13. The base pad according to claim 12, wherein said securing means comprises a detent device.

14. The base pad according to claim 13, wherein said upwardly disposed projection is a ball.

15. The base pad according to claim 12, wherein said upwardly disposed projection is a screw.

16. The base pad according to claim 12 further comprising an aperture in said outwardly extending section, said upwardly disposed projection selectively extending upward from said aperture to engage the endwall of the magazine tube when said securing means is in said engaged position.

17. The base pad according to claim 16, wherein said securing means is a ball detent device and said upwardly disposed projection is a ball.

18. The base pad according to claim 16, wherein said securing means is a screw threadably received in said aperture.

* * * * *